United States Patent [19]

Hills et al.

[11] 4,339,052

[45] Jul. 13, 1982

[54] SECONDARY SEAL FOR FLOATING ROOF STORAGE TANKS

[75] Inventors: Richard E. Hills, Coraopolis; Thomas J. Tague, Pittsburgh, both of Pa.

[73] Assignee: Pittsburgh-Des Moines Corporation, Pittsburgh, Pa.

[21] Appl. No.: 272,647

[22] Filed: Jun. 11, 1981

[51] Int. Cl.[3] ..... B65D 87/207

[52] U.S. Cl. ..... 220/226; 277/12; 277/138

[58] Field of Search ..... 220/216–223, 220/225, 226; 277/12, 32, 138

[56] References Cited

U.S. PATENT DOCUMENTS

| | | | |
|---|---|---|---|
| 3,136,444 | 6/1964 | Moyer | 220/226 |
| 3,333,725 | 8/1967 | Hirata et al. | 220/226 |
| 4,099,644 | 7/1978 | Nuttall et al. | 220/222 X |
| 4,173,291 | 11/1979 | Hills | 220/222 X |

FOREIGN PATENT DOCUMENTS

| | | | |
|---|---|---|---|
| 1290135 | 3/1963 | France | 220/225 |

*Primary Examiner*—Robert S. Ward, Jr.

*Attorney, Agent, or Firm*—Shoemaker and Mattare, Ltd.

[57] ABSTRACT

A secondary seal for a floating roof product storage tank has a cross-sectional shape substantially that of a right triangle. The hypotenuse of that right triangle contacts the primary seal and one leg of the seal extends outwardly of the roof rim. The seal is supported to extend downwardly from the rim and is deformable.

10 Claims, 4 Drawing Figures

SECONDARY SEAL FOR FLOATING ROOF STORAGE TANKS

BACKGROUND OF THE INVENTION

The present invention relates, in general, to product storage tanks having floating roofs, and, more particularly, to secondary seals used in such tanks.

Products, such as petroleum products, and the like, are frequently stored in tanks which have floating roofs.

These storage tanks utilize seals to close the annulus defined between the roof and the tank shell. Frequently, there are two seals used: a primary seal which is the major closure means between the floating roof and the tank shell to prevent product loss by evaporation and which customarily contacts the stored product, and a secondary seal which functions to protect the primary seal from the deteriorating effects of sun and acts as a barrier between the primary seal and wind gusts. The secondary seal also serves as the initial barrier in preventing foreign material from entering the tank via the annular gap between the roof and the tank shell. The secondary seal also prevents evaporative product loss, especially by protecting the product from wind gusts which form one of the principal causes of evaporative losses from open top floaters.

The secondary seal thus protects the primary seal, while also functioning to assist the primary seal in protecting the product, but does not contact the product. An analogy can be made to a boot and a shoe, where the secondary seal is analogous to a boot which both protects the shoe and assists the shoe in protecting a foot.

The assignee of the present invention also owns a further patent on a secondary seal design. This patented seal functions well on smooth walled, gasoline storage tanks.

However, there are several drawbacks to this patented seal when it is used on waxy crude storage tanks. When a floating roof is cycled in crude service, the heavy wax adheres to the tank wall above the seal. As the sun warms the wall, this crude melts and flows downwardly over the secondary seal and onto the roof. Besides emissions and safety concerns, this crude can flow into and foul drainage systems. At night, this build-up of crude on the tank wall solidifies around the secondary seal, thus freezing the seal in place. When the roof is again cycled, the secondary seal is no longer free to move and is subjected to loads that can buckle the seal or tear it and pull it apart. Such loading can also damage the roof and the wall.

Prior secondary seals do not adequately protect the primary seal and often extend above the roof, thereby inhibiting use of the entire height of a tank for storage. The amount of lost storage volume increases proportionally as the diameter of the storage tank increases. Furthermore, known secondary seals do not have a surface which contacts the tank wall with an area sufficient to maximize control of emissions and wind gusts.

Furthermore, known secondary seals will not effect a seal if the annulus between the roof and the tank wall exceeds the reach of these known seals by any amount.

SUMMARY OF THE INVENTION

The device embodying the teachings of the present invention is a secondary seal for a product storage tank having a floating roof.

The secondary seal has a cross-sectional shape substantially that of a right triangle, with one leg thereof contacting the tank wall, another leg thereof extending radially outward from the upper rim of the floating roof to from a co-planar continuation of that rim which extends to the tank wall, and a hypotenuse which extends outwardly and downwardly from the roof rim and contacts the primary seal, preferably along a substantial portion of the length of that hypotenuse. One embodiment of the device has the hypotenuse contacting the primary seal for essentially the entire length of that hypotenuse. The secondary seal is thus located to be substantially entirely beneath the roof top rim and has one leg thereof contacting the tank shell for essentially the entire length of that leg.

Since the secondary seal of the present disclosure is substantially beneath the top surface of the roof, the full height of the tank can be used for storage. Furthermore, the secondary seal disclosed herein essentially fully fills the rim annular space, and thus, wind, foreign objects and sunlight are substantially prevented from bypassing the secondary seal and contacting the primary seal and/or the product.

The secondary seal of the present invention is deformable and has the hypotenuse thereof contacting the primary seal for a substantial length of that hypotenuse. This feature limits the formation of vapor spaces or pockets between the primary seal and the secondary seal and thus reduces the risks and hazards of sparking inside vapor spaces. Furthermore, the seal is non-metallic to further reduce such hazards.

A stiff elastomeric retainer prevents the secondary seal from moving out of the rim space or from bending over on itself. This retainer, being flexible, will accommodate very tight rim spaces.

The secondary seal of the present disclosure rests on the primary seal and is pendently supported thereabove. Such upper support location, combined with the flexibility and shape of the secondary seal, permits this seal to cover gaps which exceed the reach of the upper leg of the triangular shaped seal. Thus, if the gap exceeds the reach of the upper leg, the seal will slide down the primary seal and continue to effect a seal. The seal thus effectively seals gaps which exceed the reach of the seal upper leg and which are small enough to compress the support ring.

The secondary seal disclosed herein functions well in a crude oil storage tank, although it possesses other advantages for multiple product storage. Due to the gentle compressive force of the foam and the rounded shape thereof when engaged, the seal slides over and around possible obstructions. In addition, the shape of this foam in compression provides a peeling action that eliminates the solidification and freezing problems of crude storage. The rubber stiffener contributes structural integrity to the seal, but is able to fit tightly against the wall in a reduced annular space without causing the stresses that are associated with metal stiffeners. Also, due to its simplified design, installation costs are reduced with the seal embodying the teachings of the present invention.

Some other advantages of the presently disclosed secondary seal are: being made of foam, this secondary seal can be formed into a continuous seal with no breaks occurring therein; there are no structural elements to buckle or bend; the right triangular shape provides a greater surface contact than any known seal, thereby maximizing emission and wind control; the seal is flexible enough to accommodate any distortion in the tank wall; the shape of the seal in compression provides a small trough to channel product from the shell into the tank, thus minimizing product flow onto the roof; if the tank is full, the low mounting eliminates the need for shell extension, and there is thus no storage capacity reduction; the seal is non-metallic, thus minimizing a probability of sparking; since the hypotenuse of the seal rests directly on the primary seal, the usual vapor pocket between primary and secondary seals is eliminated.

OBJECTS OF THE INVENTION

It is a main object of the present invention to provide a secondary seal for a floating roof product storage tank which effectively seals gaps having a wide variation in reach.

It is another object of the present invention to provide a secondary seal for a floating roof product storage tank which maximizes emission and wind control.

It is a further object of the present invention to provide a secondary seal for a floating roof product storage tank which permits use of the full tank height.

It is still another object of the present invention to provide a secondary seal for a floating roof product storage tank which eliminates vapor pocket development between the primary and secondary seals.

It is yet another object of the present invention to provide a secondary seal for a floating roof product storage tank which continues to seal even though gap size exceeds the reach of the seal.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
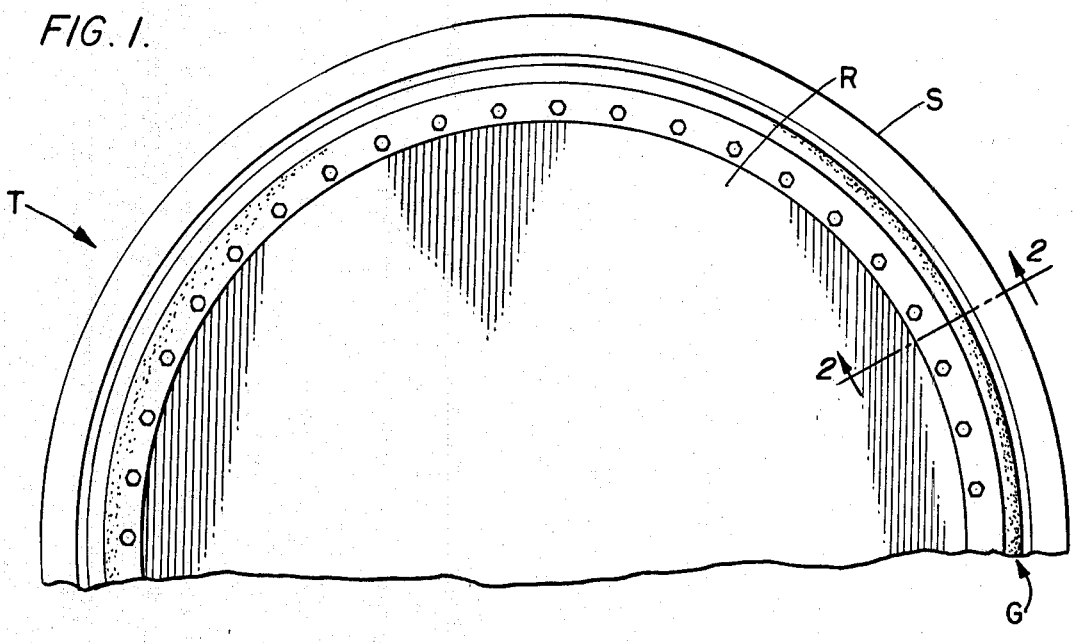
FIG. 1 is a top plan view of a portion of a floating roof product storage tank utilizing a secondary seal embodying the teachings of the present invention.

Shown in FIG. 1 is a tank T having an outer shell S and a floating roof R. An annular gap G is defined between the floating roof and inner surface I of the shell.

A primary seal is interposed between the floating roof and the tank shell and a secondary seal 10 is located superjacent such primary seal. The secondary seal forms the subject of the present disclosure, and two embodiments thereof are disclosed. The first embodiment is disclosed in FIG. 2 in conjunction with a liquid containing primary seal PSL, and the second embodiment 10' is disclosed in FIG. 3 in conjunction with a foam log primary seal PSF.

Figure 2:
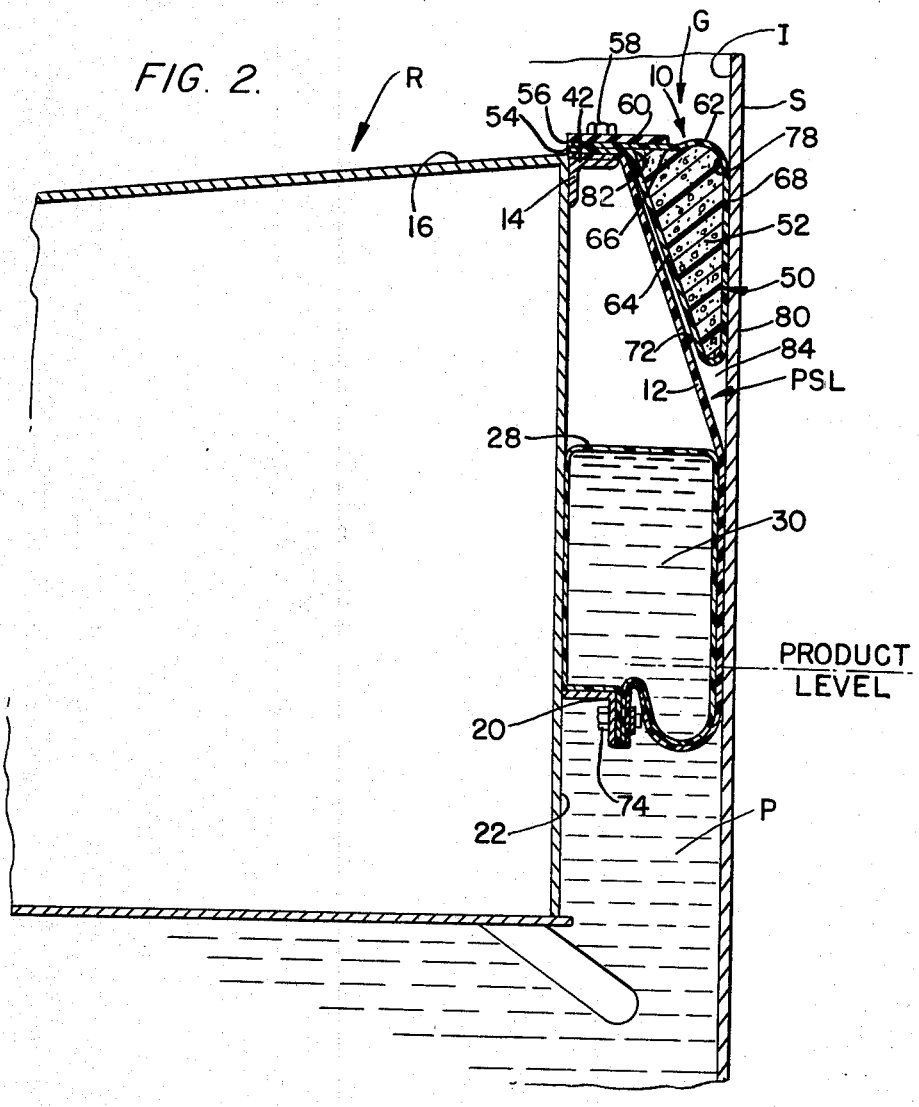
FIG. 2 is a view taken along line 2—2 of FIG. 1.

As shown in FIG. 2, product P is contained in the tank and the primary seal PSL includes a scuff band 12 attached at one end thereof to a mounting bracket 14 mounted on the floating roof near the upper surface 16 of that roof, and at the other end thereof to a mounting bracket 20 located on side surface 22 of the floating roof by a fastener 24. A tube 28 containing liquid 30 is mounted on the bracket 20 and is located between the scuff band and the floating roof. A complete disclosure of a seal similar to the primary seal PSL is contained in U.S. Pat. No. 4,173,291, the disclosure of which is incorporated herein by reference thereto.

As shown in FIG. 2, the floating roof has an upper surface 6 and the bracket 14 includes an upper surface 42. Secondary seal 10 includes a scuff band 50 surrounding a body 52 of compressed foam, or the like. The scuff band 50 has ends 54 and 56 thereof both attached together and to the bracket 14 to rest on the upper surface 42 thereof by a fastener 58. An annular, planar retainer ring 60 formed of an elastomer, such as rubber or the like, is interposed between the fastener and outer surface 62 of the scuff band 50.

The secondary seal 10 is deformable and is located to be circumambient the floating roof. The seal 10 has a cross-sectional shape substantially that of a right triangle and includes a hypotenuse 64, a first leg 66 and a second leg 68. As shown in FIG. 2, the seal 10 is attached to the floating roof to have the first leg 66 thereof form a continuation of roof upper surface 16 and to thus be located at or near the upper surface to be essentially co-planar with the roof upper rim, but to project radially outwardly of that roof.

The secondary seal hypotenuse 64 is radially outwardly declining from the mounting bracket upper surface 42 and is snugly accommodated on outer surface 72 of the primary seal scuff band. Substantially the entire seal 10 is thus located beneath the roof top surface 16, and thus the full height of the tank may be used for storage. The second leg 68 abuts inner surface I of the tank shell S for essentially the entire length of that leg from right angled apex 78 to apex 80, and the hypotenuse rests on the scuff band 12 for essentially the entire length of that hypotenuse from apex 82 to apex 80 to thereby limit formation of vapor spaces or pockets between the primary and secondary seals.

As the floating roof moves relative to the shell, the secondary seal second leg 68 rubs against the tank shell inner surface I as does the primary seal scuff band 12. The secondary seal is deformed, but deformation is controlled by the scuff band 12 and the ring 60. A gap 84 is defined between apex 80, the scuff band 12 and the tank shell.

The sealing effectiveness of the secondary seal 10 is improved over prior secondary seals because the area of contact between seal 10 and the tank shell, to-wit: the surface area of leg 68 is increased over the contact area of prior seals. Furthermore, the seal extends across essentially the entire distance between the roof and the tank shell, therefore substantially preventing undesirable objects from bypassing this seal.

Figure 3:
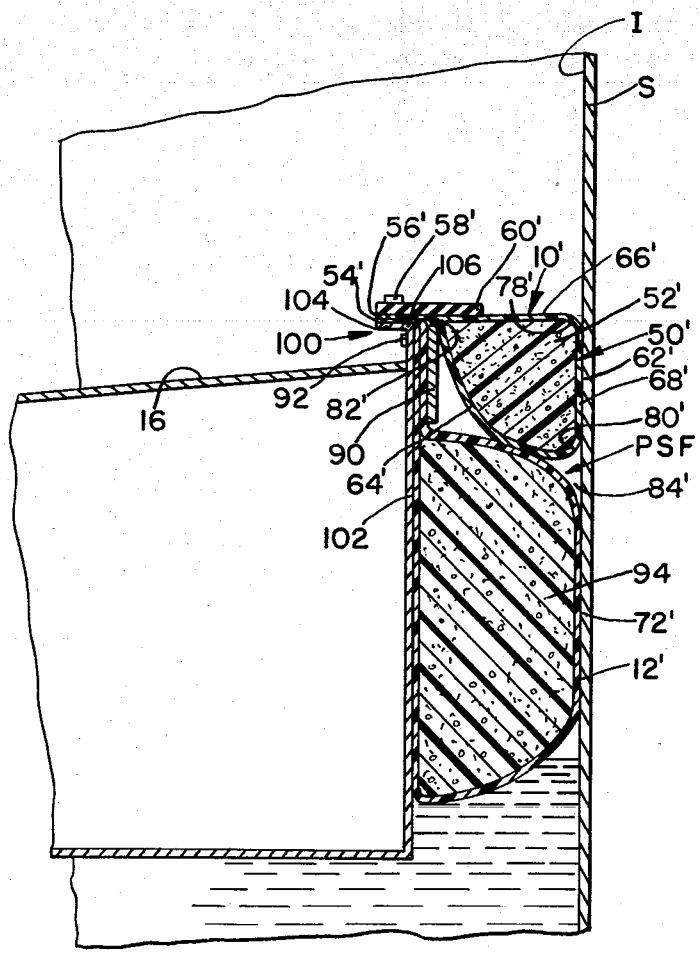
FIG. 3 is a view similar to that shown in FIG. 2, but showing an alternative primary seal.

The secondary seal 10' is shown in FIG. 3 and is used in conjunction with the primary seal PSF. The seal PSF includes a scuff band 12' attached to the roof by a clamping ring 90 and fasteners 92. A foam core 94 is contained in the scuff band 12'. As shown in FIG. 3, a bolting segment 100 of the roof side 102 extends slightly above the surface 16 of the roof and has a top flange 104 extending radially inward of the roof. The flange 104 includes top surface 106 which forms the upper rim of the floating roof.

The secondary seal 10' is also right triangular in cross-sectional shape and includes a scuff band 50' encasing a body 52' of compressed foam, or the like. The scuff band 50' includes ends 54' and 56' both attached together and to the flange 104 to rest on top surface 106 by a fastener 58'. An annular planar retaining ring 60', formed of an elastomer, such as rubber, or the like, is interposed between the fastener and outer surface 62' of the scuff band 50'.

The secondary seal 10' is deformable and is located to be circumambient the floating roof. The seal 10' has a cross-sectional shape substantially that of a right triangle and includes a hypotenuse 64', a first leg 66' and and second leg 68'. As shown in FIG. 3, the seal 10' is attached to the floating roof to have the first leg 66' thereof form a continuation of the roof upper rim 106 and to thus be essentially co-planar with that roof upper rim surface, but to project radially outwardly of the roof.

The secondary seal hypotenuse 64' is radially outwardly declining from the mounting bracket upper surface 106 and contacts outer surface 72' of the primary seal scuff band. Due to the shape of the primary seal PSF, a gap 84' is defined between the hypotenuse 64' and the scuff band 12'. As with seal 10, the second leg 68' abuts inner surface I of the tank shell S for essentially the entire length of that leg from right angled apex 78' to apex 80', and the hypotenuse rests on the scuff band 12' for a substantial portion of the length of that hypotenuse. Substantially the entire seal 10' is located beneath the top surface 106 of the flange, and thus the full height of the tank can be used for storage with seal 10', as well as with the seal 10.

Figure 4:
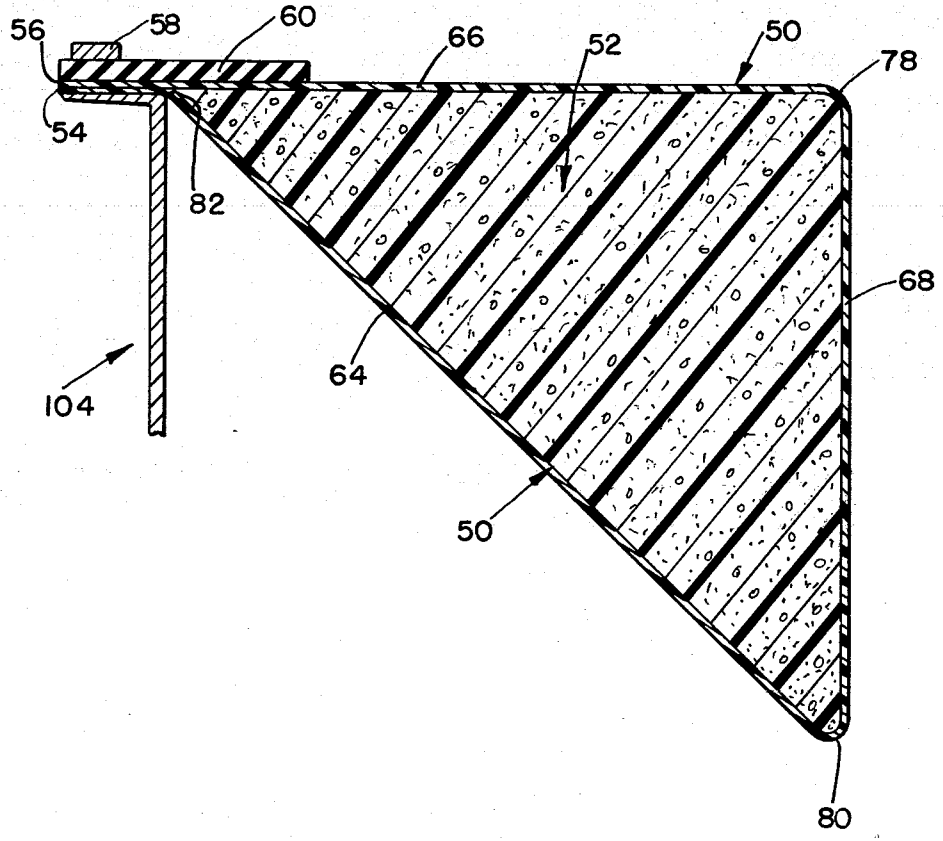
FIG. 4 is an elevation view of the seal embodying the teachings of the present invention showing the right triangular shape and top mounting thereof.

The secondary seal 10 is shown in FIG. 4, and seals 10 and 10' are identical with the exception of the bolting flange 104. The operation of seals 10 and 10' is identical except for the effect of the bolting flange 104.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A secondary seal for a floating roof located in a tank shell comprising:

a body substantially in the shape of a right triangle having a pair of legs connected to a hypotenuse;

a mounting means connected to a floating roof substantially at the top of such floating roof;

said body being connected to said mounting means and oriented so that said hypotenuse extends from said roof top to a location below said roof top away from said floating roof, and one leg extends outwardly from said floating roof to form an extension of such roof and to be essentially co-level with the rim of that roof, the other leg of the body being positioned to contact a wall of the tank shell, and said hypotenuse being located to contact an upper portion of a primary seal.

2. The secondary seal defined in claim 1 wherein said body is deformable and includes compressed foam.

3. The secondary seal defined in claim 1 wherein said other leg contacts the tank shell wall for essentially the entire length of said other leg.

4. The secondary seal defined in claim 1 further including a retainer means contacting said one leg.

5. The secondary seal defined in claim 4 wherein said retainer means includes an annular, planar elastomeric ring.

6. The secondary seal defined in claim 1 wherein said body is located to be essentially completely beneath the rim of the roof.

7. The secondary seal defined in claim 1 wherein said hypotenuse snugly accommodates an upper portion of a primary seal for essentially the entire length of said hypotenuse.

8. The secondary seal defined in claim 7 wherein the primary seal includes a liquid containing tube.

9. The secondary seal defined in claim 1 wherein the primary seal includes a foam tube.

10. The secondary seal defined in claim 1 wherein said secondary seal includes a non-metallic scuff band.

* * * * *